US008967399B2

(12) United States Patent
Hawkins et al.

(10) Patent No.: US 8,967,399 B2
(45) Date of Patent: Mar. 3, 2015

(54) CONVERTIBLE DISPLAY FIXTURE

(71) Applicant: Target Brands, Inc., Minneapolis, MN (US)

(72) Inventors: Laura L. Hawkins, Minneapolis, MN (US); Michael D. Kimmel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 146 days.

(21) Appl. No.: 13/711,172

(22) Filed: Dec. 11, 2012

(65) Prior Publication Data

US 2014/0158654 A1 Jun. 12, 2014

(51) Int. Cl.

| | |
|---|---|
| ***A47F 3/14*** | (2006.01) |
| ***A47F 5/00*** | (2006.01) |
| ***A47F 5/16*** | (2006.01) |
| *A47F 5/11* | (2006.01) |

(52) U.S. Cl.

CPC ..... *A47F 3/142* (2013.01); *A47F 5/0018* (2013.01); *A47F 5/114* (2013.01); *A47F 5/16* (2013.01); *A47B 2230/0092* (2013.01)

USPC ..... 211/126.2

(58) Field of Classification Search

CPC ..... A47F 5/0025; A47F 5/112; A47G 33/06

USPC ..... 211/13.1, 85.26, 126.1, 126.14, 133.1, 211/133.4, 126.2, 126.16, 72, 132.1; 206/507, 503, 505, 745–750, 756, 764, 206/765, 736; 229/120.17, 120.02, 120.33, 229/120.36, 120.05, 120.34, 915, 120.38; 312/129, 234, 140.4, 137, 117, 259, 312/114, 118; 220/507, 505; 108/60, 61

See application file for complete search history.

(56) References Cited

U.S. PATENT DOCUMENTS

| | | | | | |
|---|---|---|---|---|---|
| 821,350 | A | * | 5/1906 | Ferris | 312/293.2 |
| 1,934,846 | A | * | 11/1933 | Ebert | 108/101 |
| 2,297,115 | A | * | 9/1942 | Tyler | 211/126.1 |
| 2,633,285 | A | * | 3/1953 | Kells | 229/120.05 |
| 2,926,778 | A | | 3/1960 | Maguire | |
| 3,044,679 | A | | 7/1962 | Wheeler et al. | |
| 3,164,350 | A | | 1/1965 | Taub | |
| 3,165,200 | A | | 1/1965 | Hanson | |
| 3,190,438 | A | | 6/1965 | Cain et al. | |
| 3,190,439 | A | | 6/1965 | Parker | |
| 3,308,934 | A | | 3/1967 | Reiner | |
| 4,023,304 | A | * | 5/1977 | Singer | 43/54.1 |
| 4,212,506 | A | * | 7/1980 | Merl | 312/118 |
| 4,489,996 | A | * | 12/1984 | Norton et al. | 312/279 |

(Continued)

*Primary Examiner* — Joshua Rodden
*Assistant Examiner* — Hiwot Tefera
(74) *Attorney, Agent, or Firm* — Leanne Taveggia Farrell; Westman, Champlin & Koehler, P.A.

(57) ABSTRACT

A display fixture includes a base, a platform, a lattice structure, a raised shelf and a plurality of bins. The base includes an open top, a bottom floor and walls that define an interior space that is divided into sections using a plurality of partitions. The platform is located on top of the base. The raised shelf is located over the lattice structure and on top of a portion of the platform. The plurality of bins are located on the platform and on the raised shelf and are configured to display merchandise. The lattice structure and the raised shelf provide structural support for bearing a weight of merchandise located on the raised shelf. The base and the partitions dividing the base provide structural support for bearing a weight of merchandise located on the raised shelf and the platform.

16 Claims, 9 Drawing Sheets

(56) References Cited

U.S. PATENT DOCUMENTS

| | | | | | |
|---|---|---|---|---|---|
| 4,705,162 | A | | 11/1987 | Kupersmit | |
| 4,768,651 | A | * | 9/1988 | Lanius | 206/315.11 |
| 4,775,057 | A | * | 10/1988 | Zingeser | 211/133.1 |
| 4,877,137 | A | | 10/1989 | Govang et al. | |
| 5,251,753 | A | * | 10/1993 | Pigott et al. | 206/766 |
| 5,593,061 | A | * | 1/1997 | Prochnow | 220/507 |
| 5,673,796 | A | | 10/1997 | Tulloch | |
| D393,554 | S | * | 4/1998 | Baluk et al. | D6/470 |
| 5,758,783 | A | * | 6/1998 | Maglione | 211/126.2 |
| 5,911,328 | A | * | 6/1999 | Shampo | 211/40 |
| 5,984,120 | A | | 11/1999 | Johnske | |
| 6,105,796 | A | * | 8/2000 | Buchanan et al. | 211/128.1 |
| 6,227,370 | B1 | * | 5/2001 | Earnshaw et al. | 206/497 |
| 6,267,255 | B1 | * | 7/2001 | Brush | 211/59.4 |
| 6,338,410 | B1 | | 1/2002 | Wasmund | |
| 6,883,671 | B2 | | 4/2005 | Rushing | |
| 7,083,048 | B2 | | 8/2006 | Taylor et al. | |
| 7,213,707 | B2 | | 5/2007 | Hubbs et al. | |
| 7,410,094 | B2 | * | 8/2008 | Bos | 229/120.36 |
| 7,584,854 | B2 | | 9/2009 | Chandaria | |
| 7,743,921 | B2 | | 6/2010 | Hubbs et al. | |
| 7,823,732 | B2 | | 11/2010 | Lutkauskas et al. | |
| 8,100,265 | B2 | | 1/2012 | Farley | |
| 8,162,158 | B2 | * | 4/2012 | Northrup et al. | 211/90.02 |
| 2003/0052040 | A1 | | 3/2003 | Brener et al. | |
| 2003/0168368 | A1 | | 9/2003 | Terrell et al. | |
| 2004/0055982 | A1 | * | 3/2004 | Jennings | 211/126.2 |
| 2004/0140276 | A1 | * | 7/2004 | Waldron | 211/51 |
| 2008/0110789 | A1 | | 5/2008 | McLeod et al. | |

* cited by examiner

CONVERTIBLE DISPLAY FIXTURE

BACKGROUND

In retail stores, seasonal merchandise is often placed in bins for display. The type of seasonal merchandise that needs to be displayed can change over the course of the shopping season requiring different types of bins to hold different types of seasonal merchandise.

The discussion above is merely provided for general background information and is not intended to be used as an aid in determining the scope of the claimed subject matter.

SUMMARY

A display fixture includes a base, a platform, a lattice structure a raised shelf and a plurality of bins. The base includes an open top, a bottom floor and walls that define an interior space that is divided into sections using a plurality of partitions. The platform is located on top of the base. The raised shelf is located over the lattice structure and on top of a portion of the platform. The plurality of bins are located on the platform and on the raised shelf and are configured to display merchandise. The lattice structure and the raised shelf provide structural support for bearing a weight of merchandise located on the raised shelf. The base and the partitions dividing the base provide structural support for bearing a weight of merchandise located on the raised shelf and the platform.

Together, the base and the platform provide a bottom tier of the display fixture with the base including a bottom wall, a front wall, a rear wall and a pair of side walls. Together, the raised shelf and a riser located on the raised shelf provide an upper tier of the display fixture. In addition, the riser of the upper tier is configured to support a decoration that corresponds to the shopping season.

The display fixture is convertible from displaying seasonal merchandise corresponding to items the shopper would purchase at the beginning of the shopping season to displaying seasonal merchandise corresponding to items the shopper would purchase at the end of the shopping season. The display fixture conversion includes removing the plurality of bins from the platform and the raised shelf, removing the riser from the raised shelf, removing the raised shelf from the platform, removing the platform from the base, and stocking the interior space of the base with seasonal merchandise corresponding to items the shopper would purchase at the end of the shopping season.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a display fixture that can be converted from a first configuration, which displays a type of loose item seasonal merchandise, to a second configuration, which displays a different type of loose item seasonal merchandise. In this way, the same display fixture can be reused to display two different types of merchandise within the same season. In the first configuration, the type of loose item seasonal merchandise being displayed is for sale at a beginning of a shopping season. In the second configuration, the type of loose item seasonal merchandise being displayed is for sale at an end of the shopping season.

Using the Christmas shopping season as an exemplary shopping season, the display fixture in the first configuration can display decorations, such as Christmas ornaments, garlands, tree-toppers and the like, for decorating a Christmas tree. Such loose items are example products that a shopper would purchase at the beginning of the Christmas shopping season. In the second configuration, the display fixture can display rolls of gift wrap and the like. Such loose items are example products that a shopper would purchase at the end of the Christmas shopping season.

Figure 1:
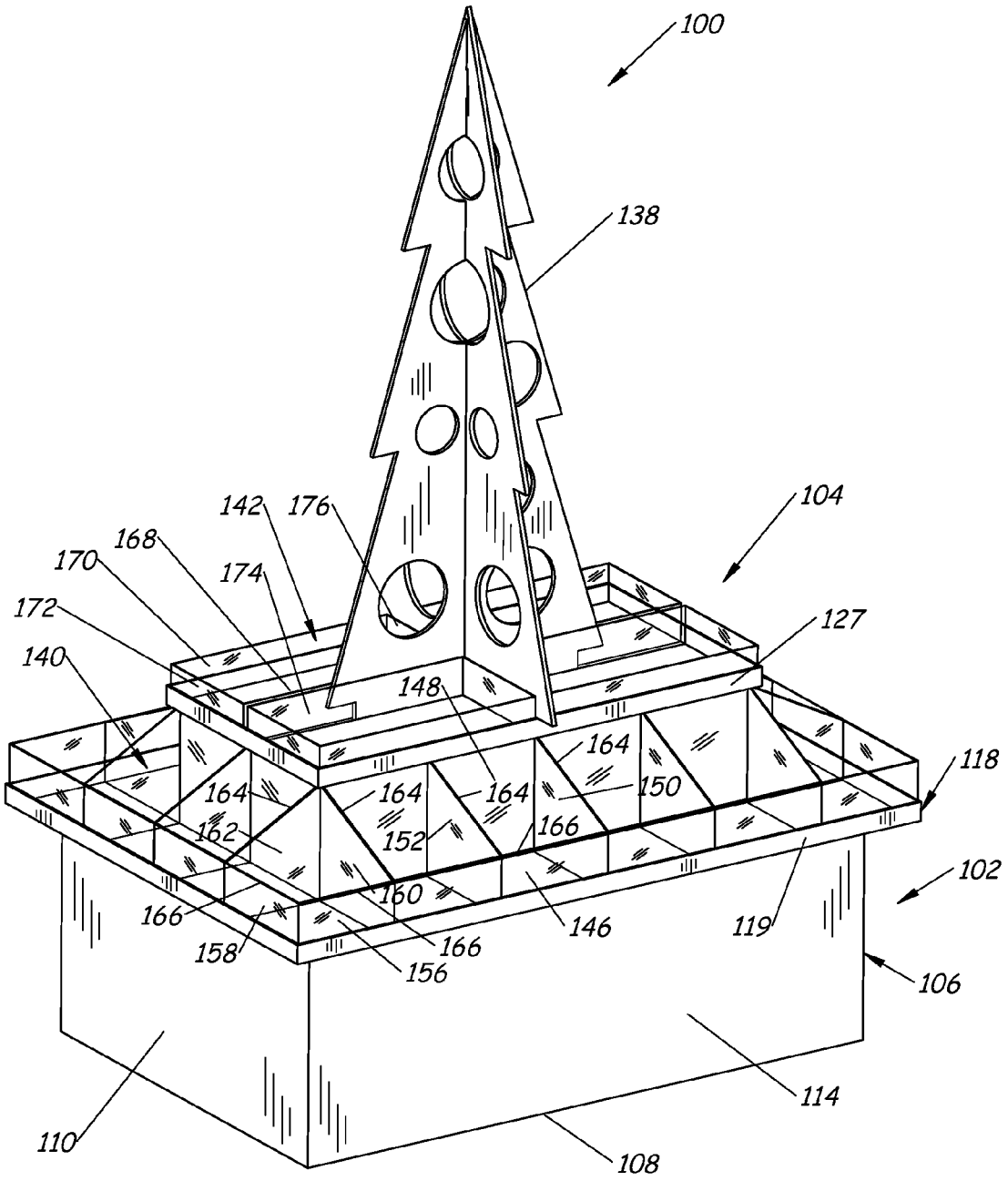
FIG. 1 is a front perspective view of a display fixture for displaying seasonal merchandise in a first configuration according to one embodiment.
Figure 2:
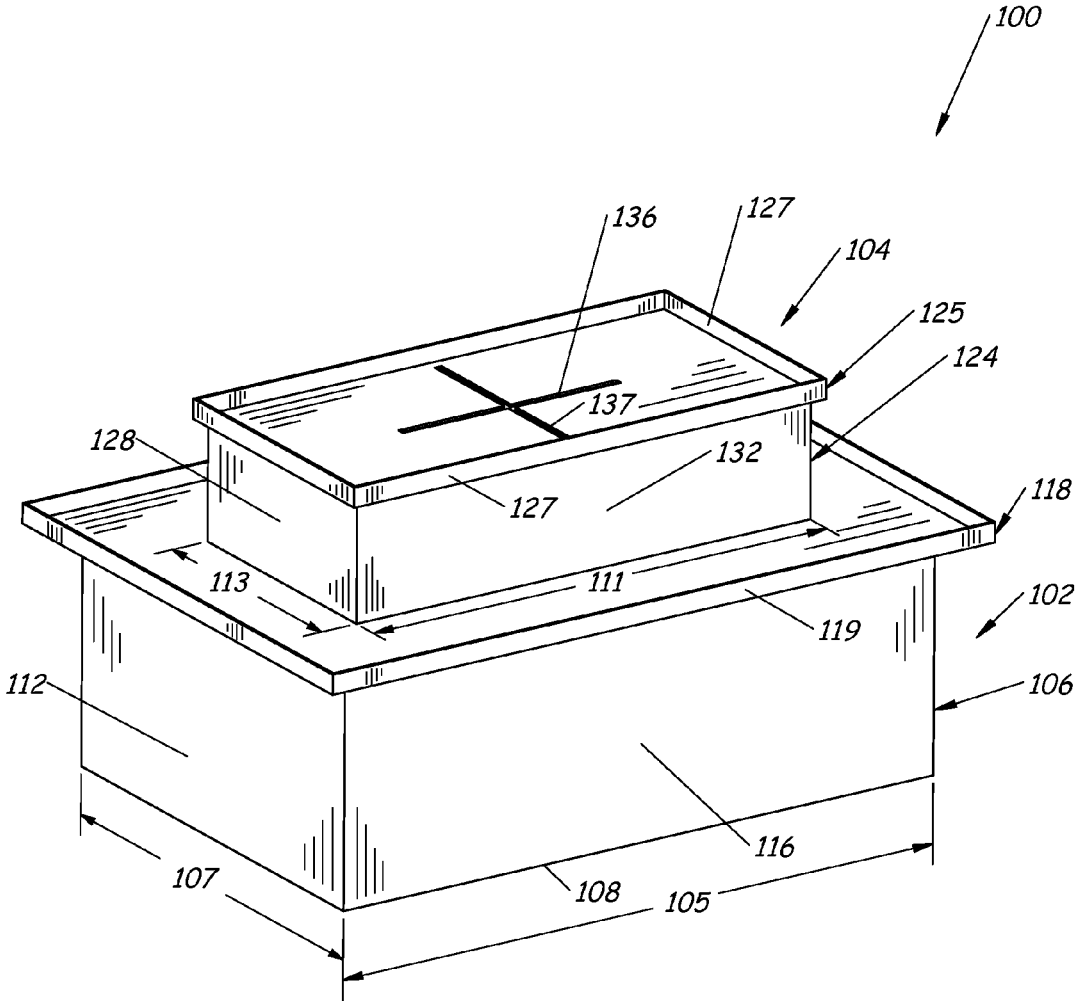
FIG. 2 is a rear perspective view of the display fixture illustrated in FIG. 1 with components removed to more clearly show the display fixture.
Figure 3:
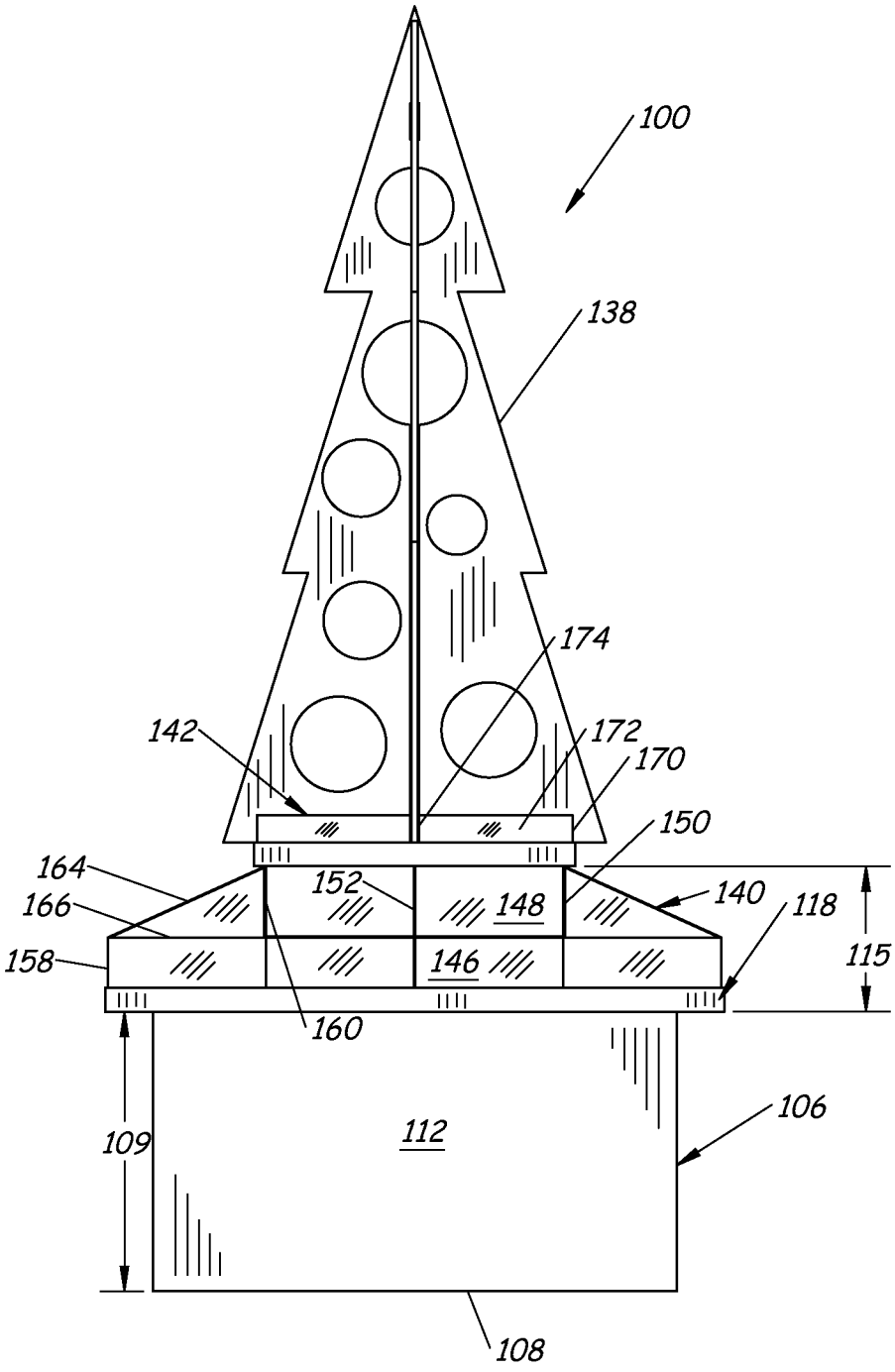
FIG. 3 is a rear view of the display fixture illustrated in FIG. 1, the front being identical.
Figure 4:
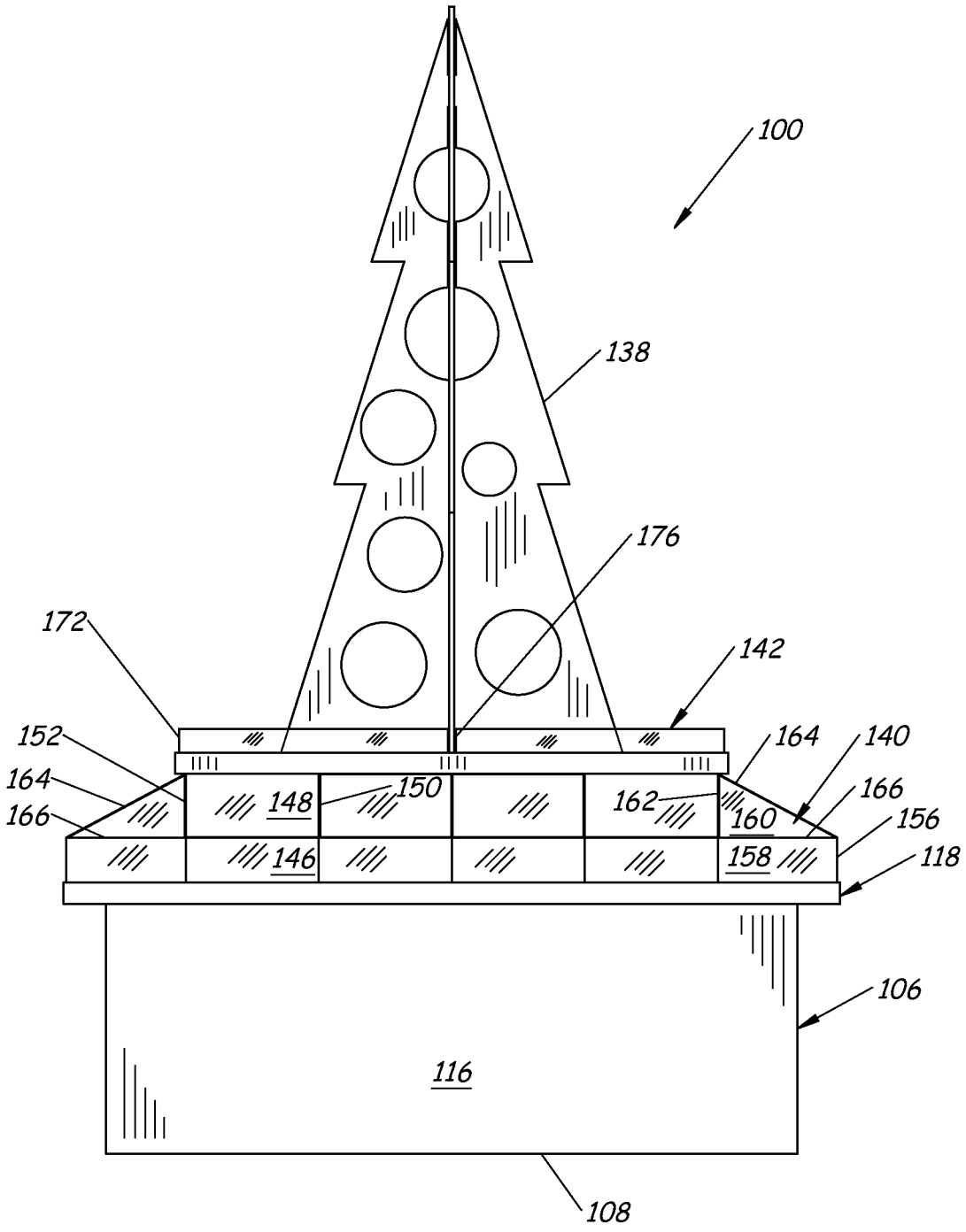
FIG. 4 is a left side view of the display fixture illustrated in FIG. 1, the right side being identical.
Figure 5:
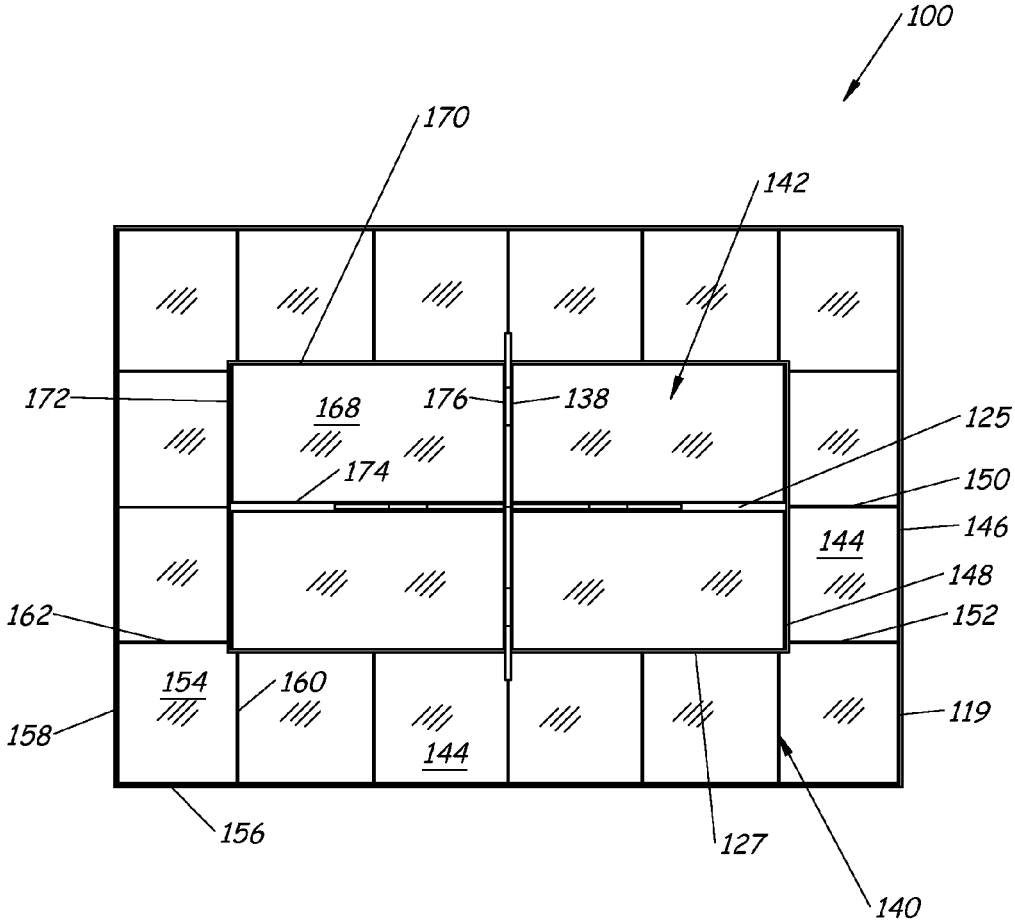
FIG. 5 is a top view of the display fixture illustrated in FIG. 1, the bottom being devoid of surface ornamentation.
Figure 8:
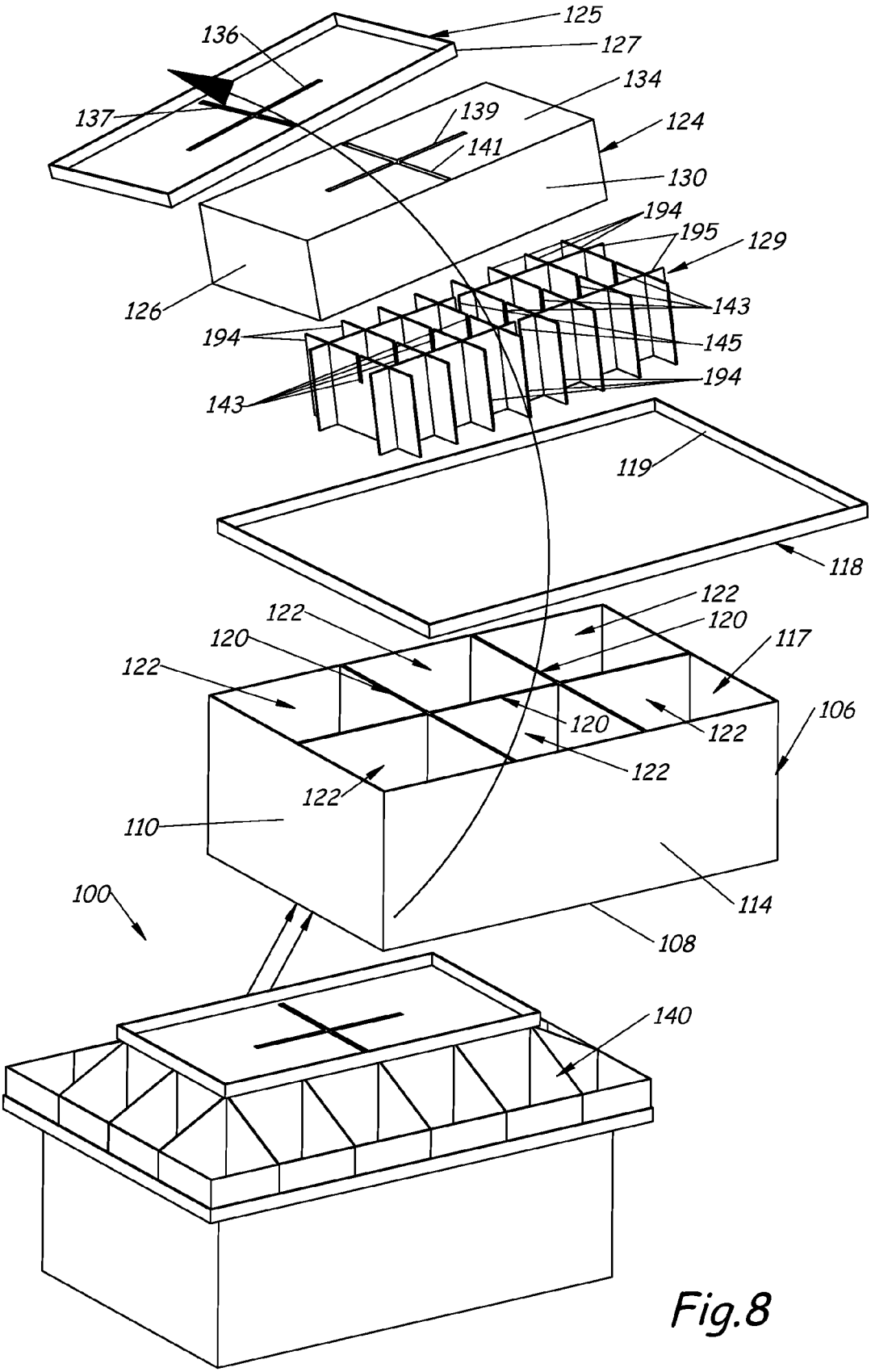
FIG. 8 is a schematic illustration of the display fixture of FIG. 1 being converted from a first configuration into a second configuration according one embodiment.
Figure 9:
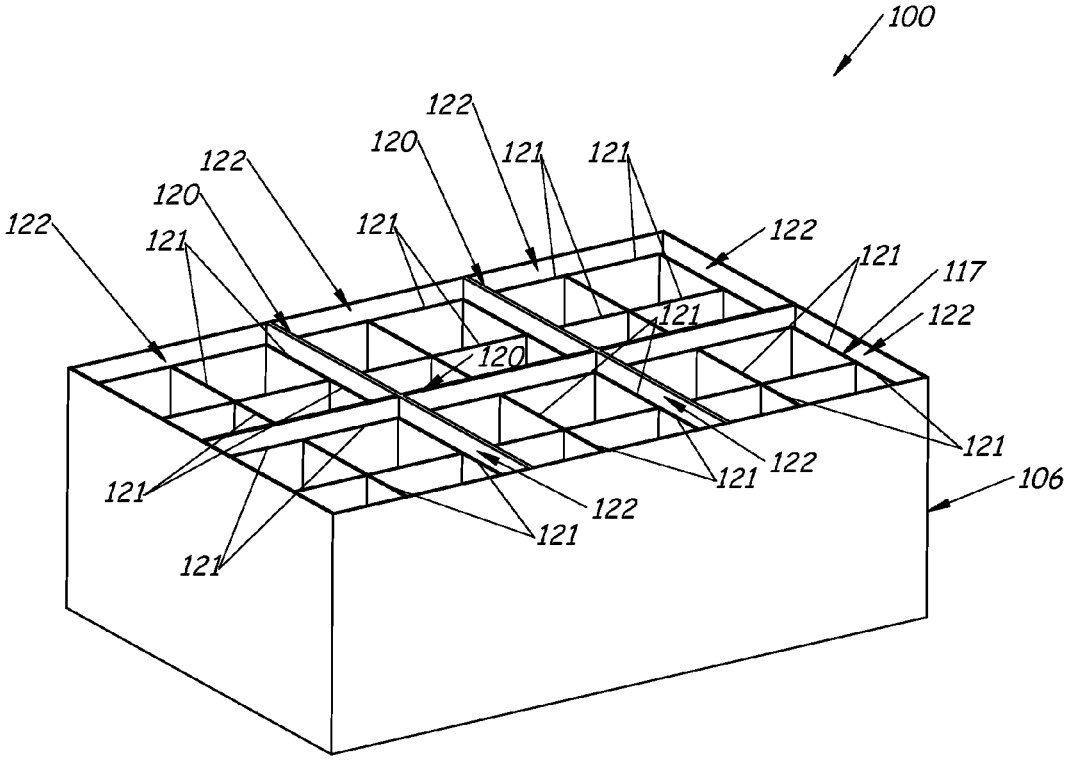
FIG. 9 is a perspective view of the display fixture illustrated in FIG. 1, but converted into a second configuration according to one embodiment.
Figure 10:
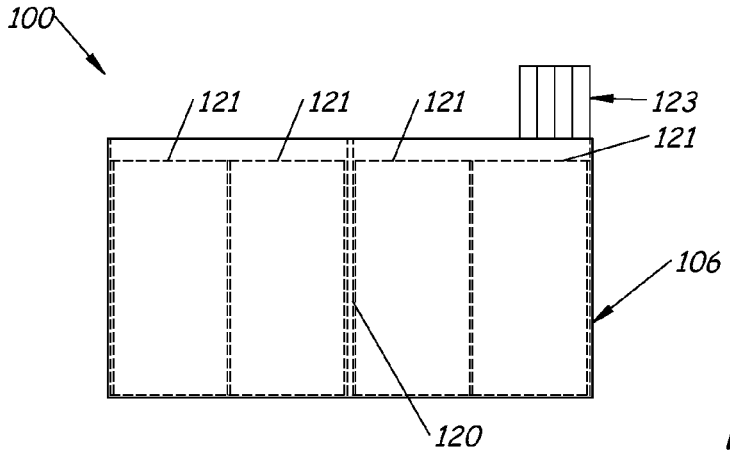
FIG. 10 is a rear view of the display fixture illustrated in FIG. 9, the front being identical.
Figure 11:
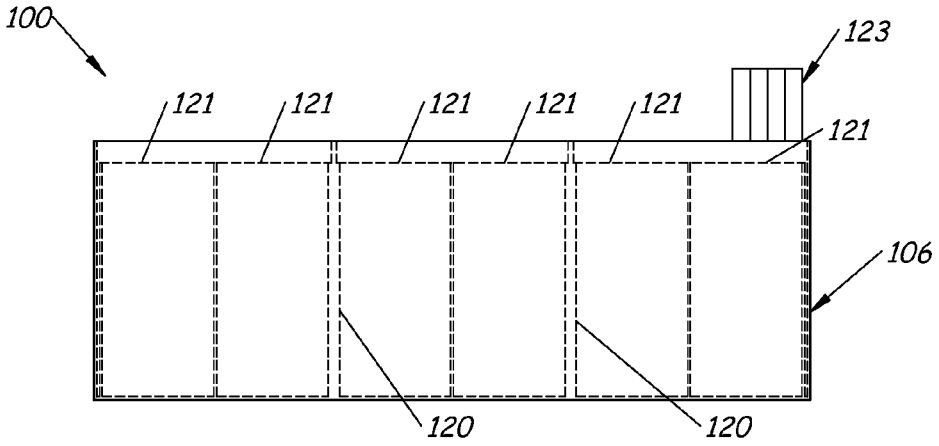
FIG. 11 is a left side view of the display fixture illustrated in FIG. 9, the right side being identical.
Figure 12:
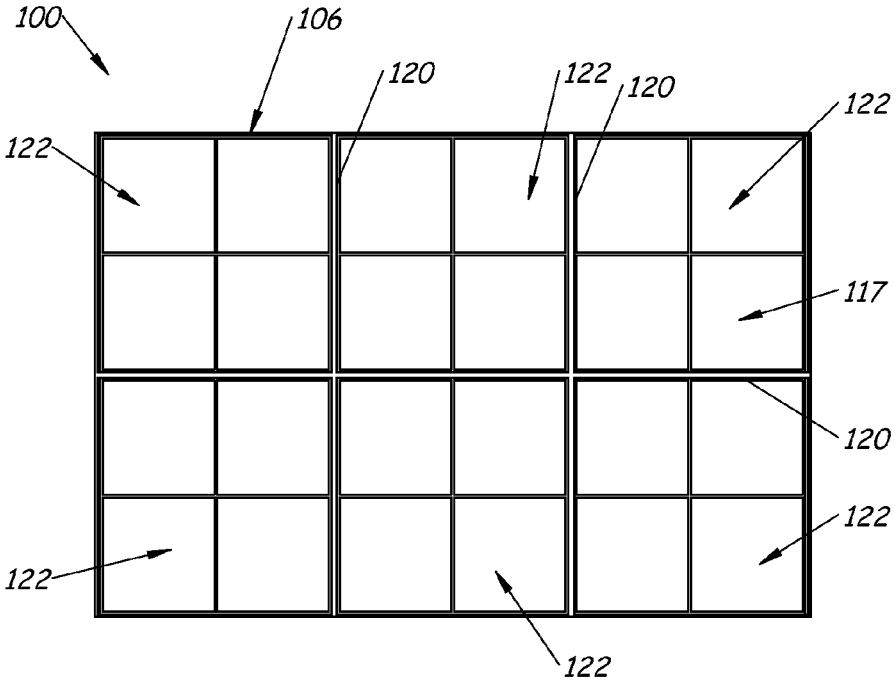
FIG. 12 is a top view of the display fixture illustrated in FIG. 9.

FIG. 1 is a front perspective view of a display fixture 100 in a first configuration according to one embodiment, while FIG. 2 is a rear perspective view of display fixture 100 with components removed to more clearly illustrate the first configuration of display fixture 100. FIG. 3 is a rear view (the front being identical) of display fixture 100 in the first configuration, FIG. 4 is a left side view (the right side being identical) of display fixture 100 in the first configuration and FIG. 5 is a top view (the bottom being devoid of surface ornamentation) of display fixture 100 in the first configuration. FIG. 8 illustrates the process of converting display fixture 100 from a first configuration into a second configuration. FIG. 9 illustrates a perspective view of display fixture 100 in a second configuration according to another embodiment. FIG. 10 is a rear view (the front being identical) of display fixture 100 in the second configuration, FIG. 11 is a left side view (the right side being identical) of display fixture 100 in the second configuration and FIG. 12 is a top view of display fixture 100 in the second configuration.

In the first configuration, display fixture 100 includes a lower tier 102 and a removable upper tier 104. Lower tier 102 includes a base 106 and a removable lower tray or platform 118. Base 106 has an open top (FIG. 8) and includes a bottom wall or floor 108, a front wall 110, a rear wall 112 and a pair of side walls 114 and 116 that define an interior space 117 (FIG. 8). As illustrated in FIGS. 8-12, base 106 includes a plurality of dividers or partitions 120 for partitioning or dividing interior space 117 into sections or cells 122. Removable lower tray or platform 118 is located on and covers the open top of base 106 and is supported by front wall 110, back wall 112, right side wall 114 and left side wall 116 of base 106 and is also supported by partitions 120. As also illustrated in FIGS. 1, 2 and 8, platform 118 includes a lip 119 located around its periphery and extending upward from a horizontal surface of platform 118.

Removable upper tier 104 includes a removable body or raised shelf 124, a removable lattice structure 129 (illustrated in FIG. 8) and a removable upper tray or riser 125. As illustrated in FIGS. 1-8, upper tier 104 is located on top of a portion of platform 118 and is supported by base 106, partitions 120 and platform 118. Lattice structure 129 is centered on and located on platform 118 and includes a plurality of widthwise slats 194 and a plurality of lengthwise slats 195 intersecting with the plurality of widthwise slats 194.

Raised shelf 124 includes a front wall 126, a back wall 128 and a pair of side walls 130 and 132 and is placed over lattice structure 129. In one embodiment and as illustrated in FIG. 8, raised shelf also includes a top or upper wall 134. Removable top or riser 125 is located on top of lattice structure 129 and raised shelf 124 and includes a pair of intersecting slots 136 and 137 that are configured to receive and support bottom edges of a decoration 138 that extends upward from riser 125 and corresponds to the shopping season. In embodiments where raised shelf 124 includes upper wall 134, upper wall 134 also includes a pair of intersecting slots 139 and 141 that correspond with slots 136 and 137 to also received and support the bottom edges of decoration 138. At least some of widthwise slats 194 of lattice structure 129 include slots 143 and each of lengthwise slats 195 of lattice structure 129 include slots 145. Slots 143 and 145 intersect with a top edge of slats 194 or 195 and are located in a position that corresponds with intersecting slots 136, 137, 139 and 141 so that bottom edges of decoration 138 can be received by and fixed within intersecting slots 136, 137, 139 and 141 without interfering with lattice structure 129. As also illustrated in FIGS. 2 and 8, riser 125 includes a lip 127 located around its periphery and extending upward from a horizontal surface of riser 125.

For example and as illustrated in FIGS. 1 and 3-7, decoration 138 that is received by intersecting slots 136 and 137 of riser 125, and in some embodiments intersecting slots 139 and 141, may be a Christmas tree, which corresponds to the Christmas shopping season. In addition and as illustrated in FIGS. 1 and 3-7, decoration 138 may correspond to the type of loose item seasonal merchandise that display fixture 100 is displaying. For example, if decoration 138 is a Christmas tree as illustrated, decoration 138 may further showcase the items being displayed for purchase as they would be used. Decoration 138 will be discussed in further detail below and in connection with FIGS. 6 and 7.

In the first configuration, display fixture 100 further includes a plurality of removable bins 140 that are located on a remaining portion of platform 118 and a plurality of removable bins 142 that are located on riser 125. The plurality of removable bins 140 and 142 are configured to hold or display seasonal merchandise or loose item season merchandise that correspond to items that a shopper would purchase at a beginning of a shopping season. For example, bins 140 and 142 are configured to hold or display ornaments that correspond to a beginning of a Christmas shopping season. As illustrated in FIGS. 1 and 2-7, both bins 140 and 142 are made of transparent material, such as transparent plastic, so as to not obscure the shopper's view of the loose item seasonal merchandise being held in the bins 140 and 142.

The plurality of removable bins 140 used in the first configuration of display fixture 100 are located on the remaining portion of removable top or platform 118 and between lip 119 and the front 126, rear 128 and side walls 130 and 132 of raised shelf 124. In one embodiment and as illustrated, there are sixteen bins 140 that surround raised shelf 124 and are retained on platform 118 by lip 119. Most of bins 140 have a floor 144 that is in the shape of a square, an open top, a front wall 146, a rear wall 148 and side walls 150 and 152. Floor 144 faces the top of platform 118, front wall 146 faces lip 119 of platform 118, rear wall 148 faces raised shelf 124 and side walls 150 and 152 face adjacent bins 140. However, corner bins 140 include a slightly different construction. Corner bins 140 include a floor 154 that is in the shape of a square, an open top, a pair of front walls 156 and 158 and a pair of side walls 160 and 162. Floor 154 faces the top of platform 118, front walls 156 and 158 face different sides of lip 119 of platform 118 and side walls 160 and 162 face adjacent bins 140. Side walls 150 and 152 of most bins 140 and side walls 160 and 162 of corner bins 140 all include top edges 164 that are tapered. The tapered top edges 164 extend from top or upper wall 134 of raised shelf 124 to a top edge 166 of front wall 146 or front walls 156 and 158. Although floor 154 is square in the figures, in other embodiments, bins 140 can have floors 154 with other shapes.

The plurality of removable bins 142 used in the first configuration of display fixture 100 are located on removable top or riser 125 and between lip 127 and decoration 138. In one embodiment, there are four bins 142 that are retained on riser 125 by lip 127. Bins 142 all include a floor 168 that is in the shape of a rectangle, an open top, a pair of front walls 170 and 172 and a pair of side walls 174 and 176. Floor 168 faces the top of riser 125, front walls 170 and 172 face lip 127 and side walls 174 and 176 face adjacent bins 142. Although floor 168 is rectangular in the figures, in other embodiments, bins 142 can have floors 168 with other shapes.

Together lattice structure 129 and raised shelf 124 structurally support the weight of riser 125, decoration 138, bins 142 and loose item merchandise that is displayed in bins 142 on riser 125, while base 106 and the plurality of partitions 120 structurally support the weight of platform 118, bins 140, loose item merchandise that is displayed in bins 140, the weight of upper tier 104 including lattice structure 129, raised shelf 124, riser 125, decoration 138, bins 142 and loose item merchandise that is displayed on riser 125.

The dimensions of bottom tier 102 are greater than the dimensions of upper tier. In particular and as illustrated in FIGS. 2 and 3, base 106 includes a length 105, a width 107 and a height 109 and raised shelf 124 includes a length 111, a width 113 and a height 115. Length 105 of base 106 is greater than length 111 of raised shelf 124. Width 107 of base 106 is greater than width 114 of raised shelf 124. Height 109 of base 106 is greater than height 115 of raised shelf 124.

Figure 6:
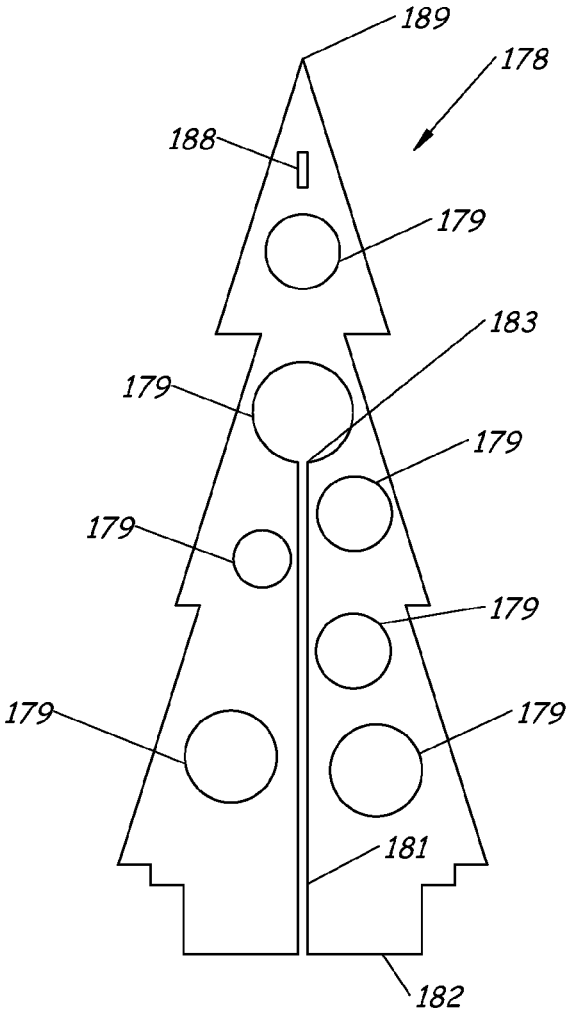
FIG. 6 is a plan view of a first panel of the decoration that is mounted to the top of the display fixture illustrated in FIG. 1.
Figure 7:
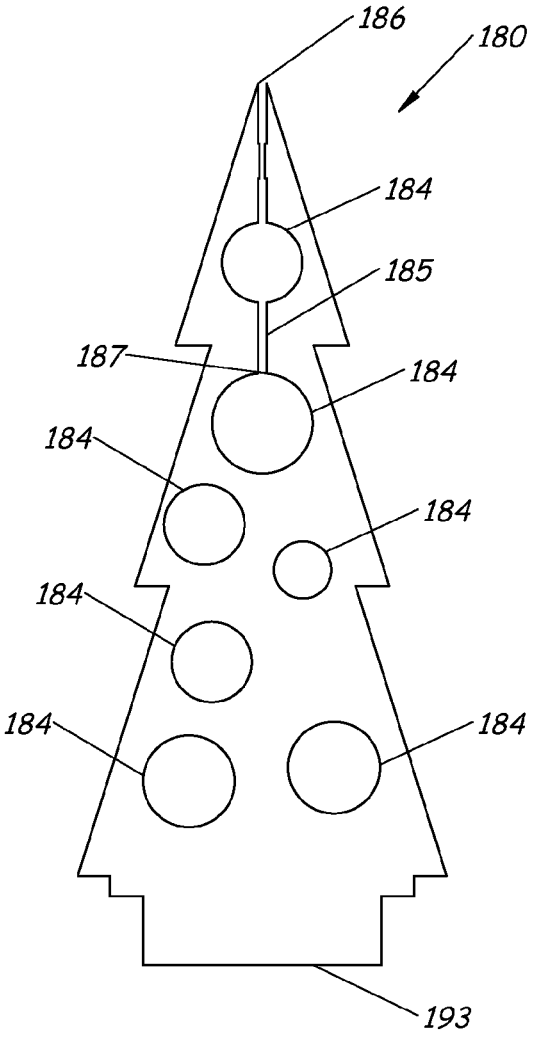
FIG. 7 is a plan view of a second panel of the decoration that is mounted to the top of the display fixture illustrated in FIG. 1.

FIG. 6 is a plan view of a first panel 178 of decoration 138, while FIG. 7 is a plan view of a second panel 180 of decoration 138. First panel 178 includes a plurality of through holes 179 and a slot 181 that extends from a bottom edge 182 to a terminating end 183 and is in alignment with a vertical center line of first panel 178. In one embodiment, through holes 179 are circles, however, in other embodiments, through holes 179 can be other geometrical or non-geometrical shapes. Some of the centers of the through holes 179 align with the vertical center line of first panel 178, and therefore, these through holes 179 intersect with the center of first panel 178, while the centers of other of the through holes 179 do not intersect with the center of first panel 178. In the embodiment illustrated in FIG. 6, terminating end 183 of slot 181 intersects with one of the through holes 179. Still further, first panel 178 includes an additional slot 188 that is in alignment with the vertical center line of first panel 178, is spaced apart from slot 181, is spaced apart from through holes 179, is located near the top of first panel 178 and does not intersect with an outer edge of first panel 178. Slot 188 is configured to be used to further mate first panel 178 to second panel 180.

Second panel 180 includes a plurality of through holes 184 and a slot 185. The plurality of through holes 184 mirror through holes 179 of first panel 178, and in one embodiment, through holes 184 are circles, however, in other embodiments, through holes 184 can be other geometrical or non-geometrical shapes. Slot 185 extends from a top 186 of second panel 180 to a terminating end 187 and is in alignment with a vertical center line of second panel 180. As is the case with first panel 178, some of the centers of the through holes 184 align with the vertical center line of second panel 180, and therefore, intersect with the center of second panel 180, while the centers of other of the through holes 184 do not intersect with the center of second panel 180. In the embodiment illustrated in FIG. 7, terminating end 187 of slot 185 intersects with one of the through holes 184. In addition, slot 185 traverses completely through one of the through holes 184.

To assemble first panel 178 and second panel 180 into three-dimensional decoration 138, first panel 178 is oriented substantially perpendicular or normal to second panel 180, first panel 178 is inserted into or mates with slot 185 of second panel 180 along slot 181 and first panel 178 is pushed downward relative to panel 180 until top 189 of panel 178 is aligned with top 186 of second panel 180. In addition, slot 185 includes an area that is less wide than a remaining area of slot 185 and is located near the top of second panel 180. This area of smaller width is configured to insert into slot 188 of first panel 178 to provide further mating connection between first panel 178 and second panel 180.

To assemble decoration 138 to display fixture 100 while display fixture 100 is in the first configuration, bottom edge 182 of first panel 178 is inserted into and secured by one of the intersecting slots 136 and 137 of riser 125 and intersecting slots 139 and 142 of raised shelf 124 Bottom edge 193 of second panel 180 is inserted into and secured by the other of the intersecting slots 136 and 137 and 139 and 141. As previously discussed and in one exemplary embodiment that is not specifically illustrated, ornaments that are displayed for sale in the plurality of bins 140 and 142 can be attached to edges of holes 179 and 184 and hang within holes 179 and 184 for display.

As mentioned above, FIG. 8 illustrates the process of converting display fixture 100 from a first configuration into a second configuration. The first configuration, which is illustrated without decoration 138 or bins 142 at the bottom in FIG. 8, is converted into the second configuration, which is illustrated above the first configuration in FIG. 8. To do this, the plurality of bins 140 are removed from the platform 118 and riser 125. Then, riser 125 is removed from raised shelf 124, raised shelf 124 is removed from platform 118, lattice structure 129 is removed from platform 118 and platform 118 is removed from base 108. To finish the conversion of display fixture 100 from the first configuration to the second configuration, interior space 117 of base 108 is stocked with seasonal merchandise corresponding to items the shopper would purchase at the end of the shopping season for display.

As mentioned above, FIGS. 9-12 illustrate a perspective view and various orthographic views of display fixture 100 in the second configuration. While FIG. 8 illustrates interior space 117 of base 108 having the plurality of dividers or partitions 120 for partitioning or dividing interior space 117 into sections or cells 122, FIGS. 9-12 illustrate interior space 117 as including further partitioning or dividing of cells 122. In one embodiment, each cell 122 receives a plurality of bulk shippers 121 containing seasonal merchandise that corresponds to items the shopper would purchase at the end of the shopping season.

Bulk shippers 121 are containers in which merchandise can be shipped and displayed in at a retail store. In the embodiment illustrated in FIGS. 9-12, bulk shippers 121 are rectangular boxes that hold rolls of gift wrap 123. In particular, each cell 122 is sized to receive four bulk shippers 121 filled with rolls of gift wrap 123. As illustrated in FIGS. 10 and 11, the seasonal merchandise 123 is a type of merchandise that extends outside of base 106 so the shopper does not have to bend down to pull out merchandise and the merchandise is visible outside of base 106 for making a selection. In other embodiments, each cell 122 can receive other types of bulk shippers containing other types of merchandise that correspond to items a shopper would purchase at the end of the shopping season. In addition, each cell can receive partitions or dividers for further dividing up each cell 122, but not in the form of a bulk shipper. In this way, types of merchandise can be put on display for purchase other than products that are shipped to the retail store in a bulk shipper.

In this way, partitions 120 that are placed in base 106 serve two purposes. First, partitions 120 provide structural support for bearing the loads placed on the lower tier 102 and the upper tier 104 including the weight of the components of the display fixture, but also the weight of loose item merchandise that is on display. Second, partitions 120 provide sectioning of base 102 so that it can receive loose item merchandise for display that is both visible and easy to select.

Although the subject matter has been described in language specific to structural features and/or methodological acts or processes, it is to be understood that the subject matter defined in the appended claims is not necessarily limited to the specific features or acts described above. Rather, the specific features and acts described above are disclosed as exemplary forms of implementing the claims.

What is claimed is:

1. A display fixture comprising:

a base having an open top, a bottom floor and walls that define an interior space that is divided into sections using a plurality of partitions;

a platform located on top of the base;

a lattice structure centered on the platform and including a plurality of widthwise slats and a plurality of lengthwise slats intersecting the plurality of widthwise slats;

a raised shelf located over the lattice structure and on top of a portion of the platform;

a riser located on top of the raised shelf; and a plurality of bins located on the platform and on the raised shelf and configured to display merchandise;

wherein the plurality of bins located on the raised shelf are located on the riser;

wherein the lattice structure and the raised shelf provide structural support for bearing a weight of merchandise located on the raised shelf;

wherein the base and the partitions dividing the base into sections provide structural support for bearing a weight of merchandise located on the raised shelf and the platform;

wherein the lattice structure further comprises a slot in at least some of the widthwise slats and a slot in each of the lengthwise slats, each slot intersecting with top edges of the widthwise slats or top edges of the lengthwise slat; and wherein the raised shelf comprises an upper wall having a pair of intersecting slots and wherein the riser comprises a pair of intersecting slots that correspond with the intersecting slots of the upper wall of the raised shelf, the intersecting slots of the raised shelf and the intersecting slots of the riser receive a decoration that extends upward from the riser, wherein the slots in the widthwise slats and the slots in the lengthwise slats are located in a position that corresponds with intersecting slots in the raised shelf and in the riser so that edges of the decoration can be received by and fixed within the intersecting slots of the raised shelf and the riser without interfering with the lattice structure.

2. The display fixture of claim 1, wherein the plurality of bins comprise a plurality of transparent bins.

3. The display fixture of claim 1, wherein the plurality of bins located on the platform comprise side walls having tapered top edges, the tapered top edges extending from a top of the raised shelf to a front wall of the plurality of bins.

4. The display fixture of claim 1, wherein the platform further comprises a lip located around its periphery to retain the plurality of bins on the platform.

5. The display fixture of claim 1, wherein the riser comprises a lip located around its periphery to retain the plurality of bins.

6. A display fixture comprising:

a bottom tier including a bottom wall, a front wall, a rear wall, a pair of side walls, a removable tray and a plurality of dividers for partitioning an interior of the bottom tier, wherein the partitioned interior is configured to display seasonal merchandise corresponding to items a shopper would purchase at an end of a shopping season;

a removable upper tier located on top of a portion of the removable tray of the bottom tier and including an upper wall, a front wall, a rear wall, a pair of side walls, and a removable tray located on the upper wall, the upper wall and the removable tray of the upper tier support a decoration that corresponds to the shopping season; and a plurality of removable bins located on a remaining portion of the removable tray of the bottom tier and on the removable tray of the removable upper tier, the plurality of removable bins configured to display seasonal merchandise corresponding to items a shopper would purchase at a beginning of the shopping season;

wherein the removable tray of the bottom tier includes a lip located around an entire periphery of a bottom wall of the removable tray of the bottom tier and extends upward from the bottom wall of the removable tray of the bottom tier to retain the plurality of removable bins located on the removable tray of the bottom tier;

wherein the removable tray of the upper tier includes a lip located around an entire periphery of a bottom wall of the removable tray of the upper tier and extends upwards from the bottom wall of the removable tray of the upper tier to retain the plurality of removable bins located on the removable tray of the upper tier;

wherein the removable upper tier further comprises a lattice structure centered on the removable tray of the bottom tier and is covered by the upper wall, the front wall, the rear wall and the pair of side walls of the removable upper tier, the lattice structure including a plurality of widthwise slats and a plurality of lengthwise slats, each of the lengthwise slats having a slot that intersects with a top edge of each lengthwise slat and at least some of the widthwise slats including a slot that intersects with a top edge of the at least some of the widthwise slats.

7. The display fixture of claim 6, wherein the decoration comprises a first panel having a slot extending from a bottom edge of the first panel to a terminating end and a second panel having a slot extending from a top of the second panel to a terminating end, wherein the first panel mates with the slot of the second panel along the slot of the first panel such that first panel is oriented substantially normal to the second panel to form a three-dimensional decoration.

8. The display fixture of claim 6, wherein the plurality of bins comprise a plurality of transparent bins.

9. The display fixture of claim 6, wherein the partitioned interior of the bottom tier is configured to receive a plurality of bulk shippers containing seasonal merchandise corresponding to items the shopper would purchase at the end of the shopping season.

10. The display fixture of claim 6, wherein the upper wall of the upper tier comprises a pair of intersecting slots and the removable tray of the upper tier comprises a pair of intersecting slots that match the pair of intersecting slots on the upper wall, wherein the pair of intersecting slots in the upper wall and the pair of intersecting slots in the removable tray of the upper tier receive the decoration so that the decoration extends upward from the removable tray of the upper tier.

11. The display fixture of claim 10, wherein the slots in the lengthwise slats and in the widthwise slats of the lattice structure are located in positions that correspond with the intersecting slots in the upper wall and the removable tray in the upper tier so that edges of the decoration can be received by and fixed within the intersecting slots of the upper wall without interfering with the lattice structure.

12. A display fixture comprising:

a base having an open top and an interior space divided into sections using a plurality of partitions;

a removable platform covering the open top of the base and being supported by the base;

a removable lattice structure centered on the removable platform and including a plurality of widthwise slats and a plurality of lengthwise slats, each of the lengthwise slats including a slot that intersects with a top edge of each lengthwise slat and at least some of the widthwise slats including a slot that intersects with a top edge of the at least some of the widthwise slats; and a removable raised shelf having an upper wall with a pair of intersecting slots and being located over the removable lattice structure and on top of a portion of the removable platform, wherein the removable raised shelf is supported by the base and the removable platform;

wherein the pair of intersecting slots receive a removable decoration that extends upward from the removable raised shelf, the slots in the lengthwise slats and in the widthwise slats of the removable lattice structure are located in positions that correspond with the intersecting slots in the raised shelf so that edges of the decoration can be received by and fixed within the intersecting slots of the removable raised shelf without interfering with the lattice structure.

13. The display fixture of claim 12, wherein the removable raised shelf is removed from the removable platform when the display fixture is converted from holding loose ornaments to holding wrapping paper rolls.

14. The display fixture of claim 12, further comprising a first set of removable bins located on at least a portion of the removable platform and holds loose ornaments for displaying at a beginning of a shopping season.

15. The display fixture of claim 14, further comprising a second set of removable bins located on top of the removable raised shelf.

16. The display fixture of claim 15, wherein the second set of removable bins and the removable decoration are removed from the removable raised shelf when the display fixture is converted from holding loose ornaments to holding wrapping paper rolls.

* * * * *